US006155399A

United States Patent [19]

Bruner

[11] Patent Number: 6,155,399

[45] Date of Patent: Dec. 5, 2000

[54] COIN ACCEPTANCE SYSTEM INCLUDING ANTI-FRAUD FEATURE

[75] Inventor: Philemon L. Bruner, Katy, Tex.

[73] Assignee: Imonex, Inc., Katy, Tex.

[21] Appl. No.: 09/239,431

[22] Filed: Jan. 28, 1999

[51] Int. Cl.[7] ..... G07D 7/00; G07F 1/00

[52] U.S. Cl. ..... 194/203; 194/351

[58] Field of Search ..... 194/203, 202, 194/351, 245

[56] References Cited

U.S. PATENT DOCUMENTS

| | | | |
|---|---|---|---|
| 688,211 | 12/1901 | Uchermann . | |
| 917,629 | 4/1909 | Long . | |
| 969,272 | 9/1910 | Grover . | |
| 1,087,307 | 2/1914 | Long . | |
| 1,503,223 | 7/1924 | Bee . | |
| 1,907,064 | 5/1933 | Gottfried . | |
| 1,933,752 | 11/1933 | Parks et al. | 194/102 |
| 2,009,609 | 7/1935 | Edison | 133/3 |
| 2,014,506 | 9/1935 | Patche | 194/102 |
| 2,049,170 | 7/1936 | Mills | 194/101 |
| 2,292,628 | 8/1942 | Fry | 194/99 |
| 2,442,890 | 6/1948 | Gabrielsen et al. | 194/102 |
| 2,453,437 | 11/1948 | Hokanson | 194/99 |
| 2,683,517 | 7/1954 | Gabrielsen | 194/203 |
| 3,378,126 | 4/1968 | Kuckens et al. | 194/100 |
| 3,411,613 | 11/1968 | Andreas | 194/97 |
| 3,575,273 | 4/1971 | Lajeunesse | 194/101 |
| 3,768,618 | 10/1973 | Collins | 194/102 |
| 4,111,215 | 9/1978 | Wicklander | 133/3 |
| 4,396,029 | 8/1983 | Anderson | 133/3 |
| 4,874,347 | 10/1989 | Kobayashi et al. | 453/5 |
| 4,911,280 | 3/1990 | Bruner | 194/338 |

FOREIGN PATENT DOCUMENTS

| | | | |
|---|---|---|---|
| 4547/26 | of 1926 | Australia . | |
| 331.271 | 4/1903 | France . | |
| 523069 | 4/1931 | Germany . | |
| 3007484 | 10/1981 | Germany . | |
| 53142 | 11/1989 | Germany . | |
| 19922 | 9/1929 | Netherlands . | |
| 193704 | 4/1937 | United Kingdom . | |
| 34801/57 | 11/1957 | United Kingdom . | |
| 1 321 241 | 6/1973 | United Kingdom . | |
| 1 464 702 | 2/1977 | United Kingdom | 194/203 |
| 2105893 | 3/1983 | United Kingdom . | |
| WO88/08174 | 10/1988 | WIPO . | |

OTHER PUBLICATIONS

U.S. Patent No. 4,347,924 to Hayashi et al., granted Sep. 7, 1982.

U.S. Patent No. 4,254,857 to Levasseur et al., granted Mar. 10, 1981.

U.S. Patent No. 2,122,550 to Adrian, granted Jul. 5, 1938.

French Patent No. 469,847 to Mabilee and Parquin Co., granted May 29, 1914.

*Primary Examiner*—Robert P. Olszewski
*Assistant Examiner*—Bryan Jaketic
*Attorney, Agent, or Firm*—Sankey & Luck, L.L.P.

[57] ABSTRACT

A system to effect coin discrimination and rejection comprises an arcuate control element pivotably disposed in a coin race with respect to a rejection body. The downstream end of the element is biased across the coin race. A coin passing through the race engages the downstream end of the element, thereby pivoting the element so as to prevent the passage of additional coins down the coin race.

25 Claims, 5 Drawing Sheets

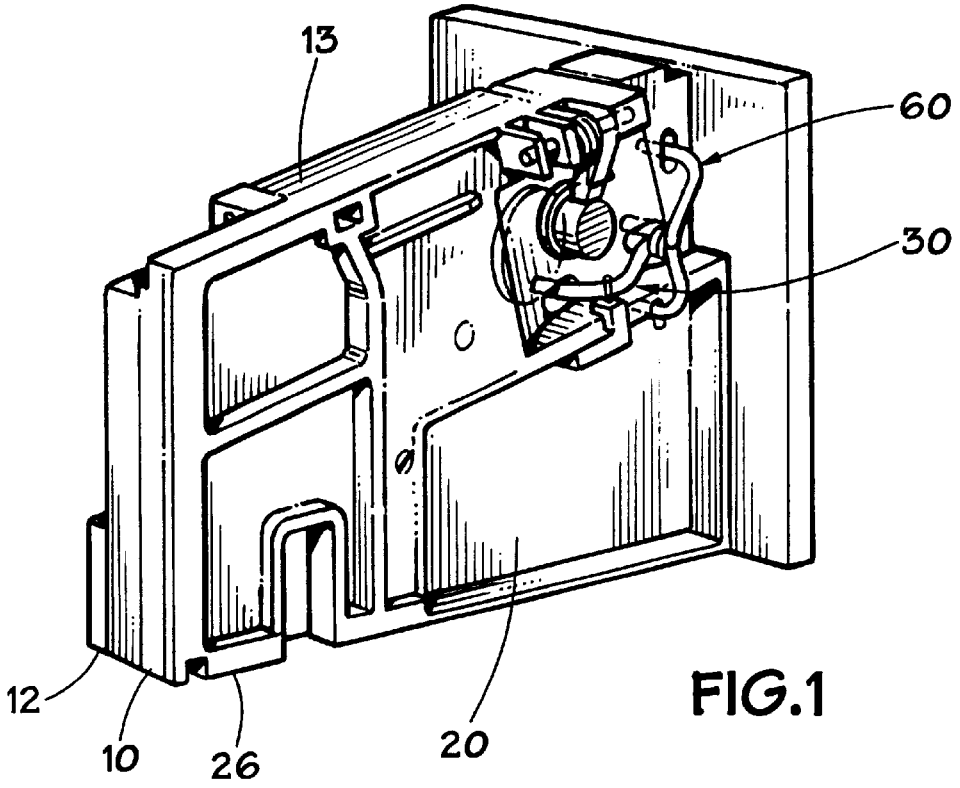
FIG.1
FIG.2
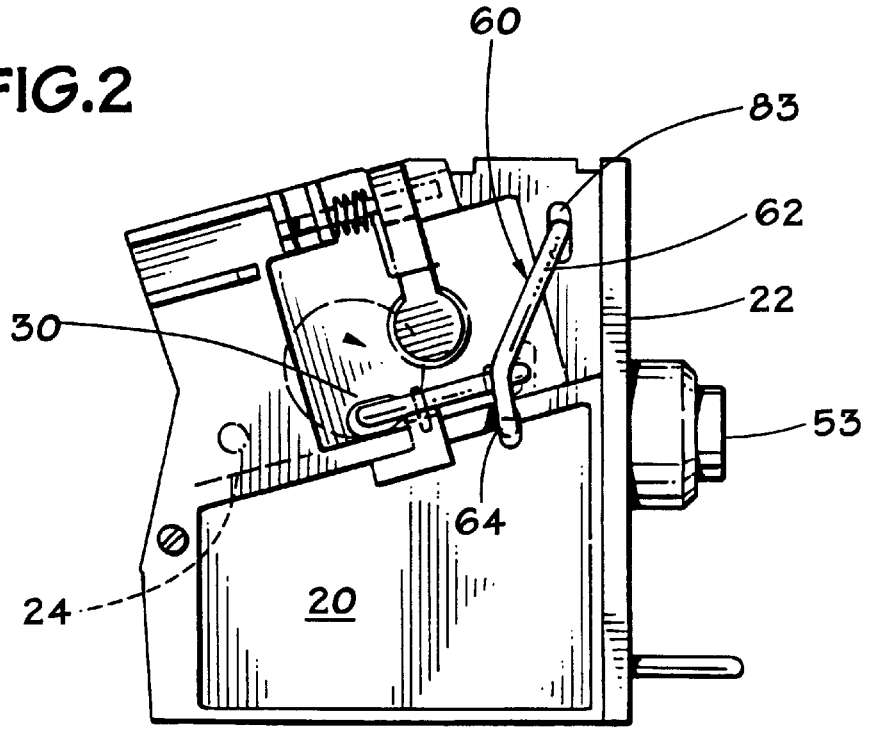

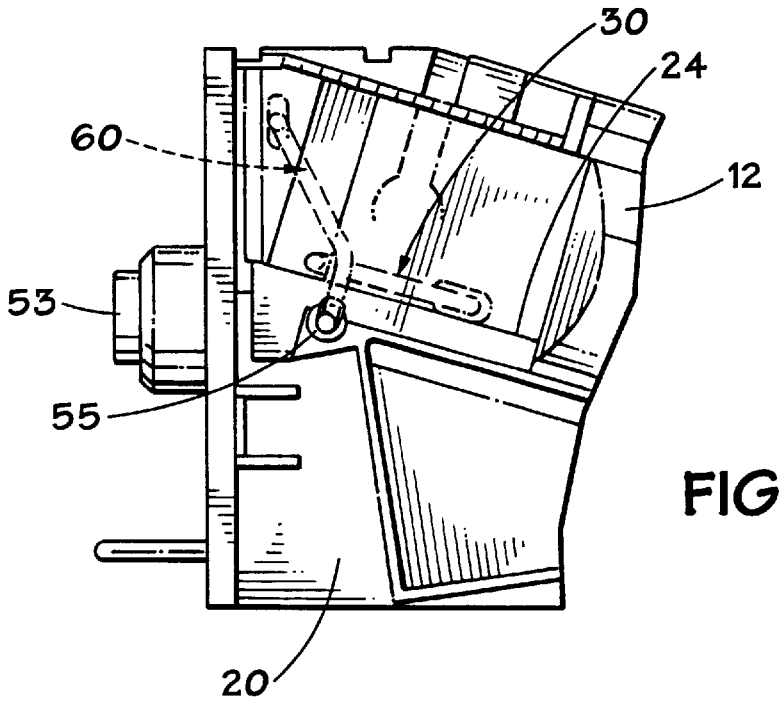
FIG.3
FIG.4
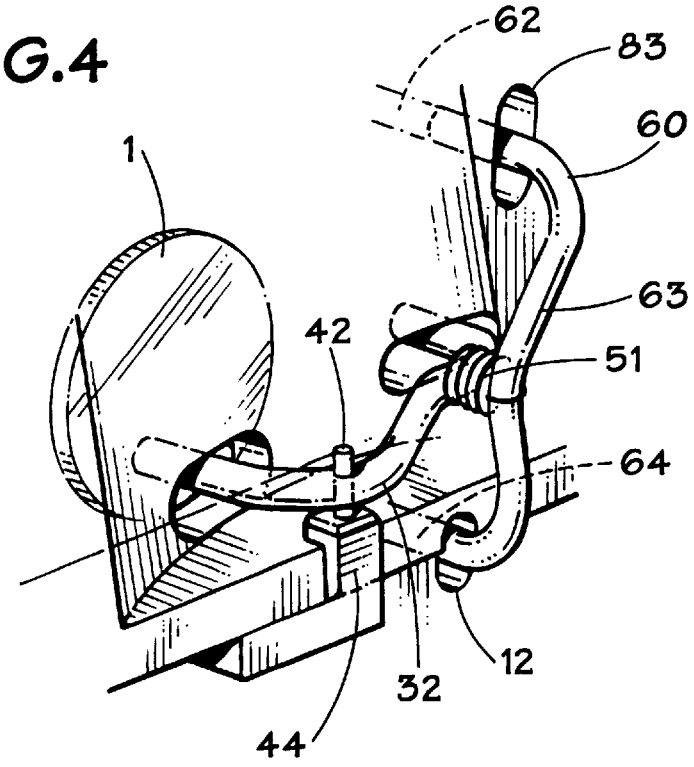

FIG.5
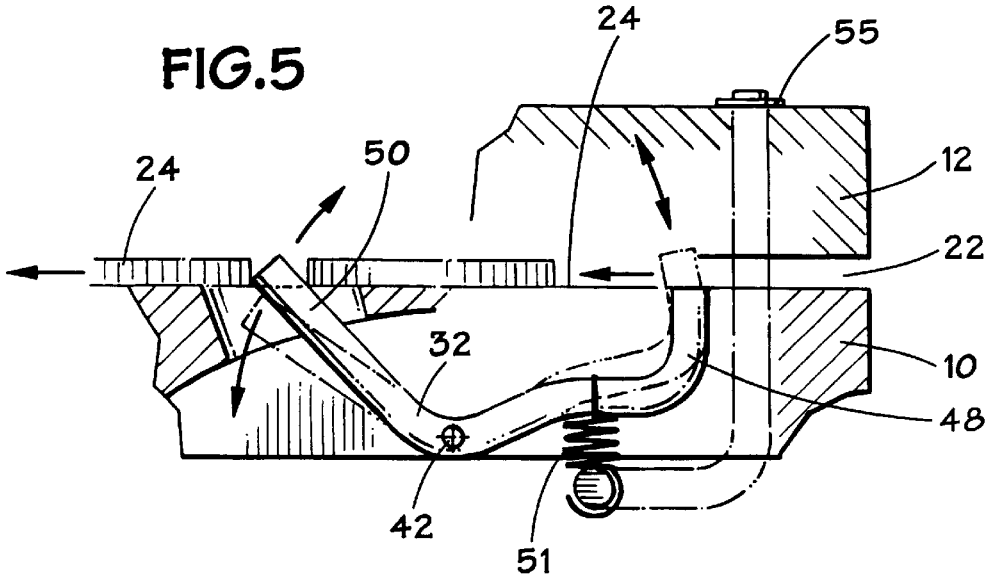
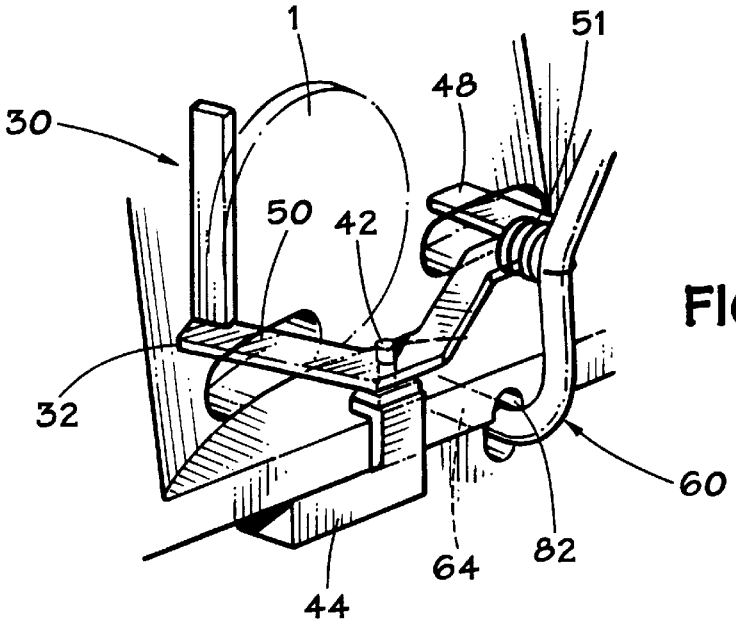
FIG.6
FIG.7
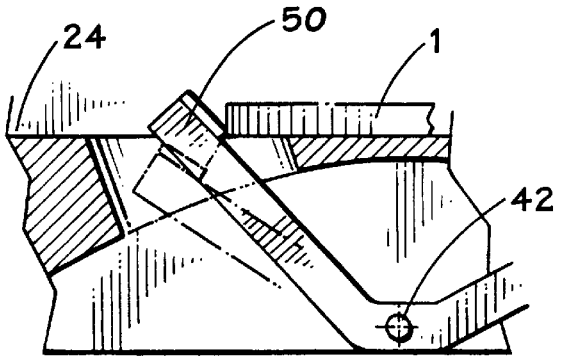

COIN ACCEPTANCE SYSTEM INCLUDING ANTI-FRAUD FEATURE

BACKGROUND OF THE INVENTION

1. Field of the Invention

The present invention relates generally to coin discrimination and rejection systems for use in vending machines, coin-operated telephones, video game machines or other applications where mechanical sorting, selection and rejection of coins is required. More specifically, the present invention is directed to a system to be used with coin separation and rejection systems to minimize fraudulent access to services and products provided by a coin-operated device.

2. Description of the Prior Art

The simplest type of coin-operated machine is one which requires a single coin of a single denomination for operation. In this connection, the basic consideration or problem involving a separator/rejector is to accept the single coin and reject all others. The problem is solved in one aspect by designing the coin inlet to accept coins no larger in diameter than the desired coin. In a second aspect, the coins which pass through the inlet enter a separator/rejector which accepts the desired coins—i.e., the largest coins—and rejects all smaller coins.

More complex coin-operated machines are designed to perform a variety of functions such as accepting combinations of coin denominations, returning change, and returning undesirable coins, tokens and counterfeit coins. The more complex machines therefore require more complex separator/rejectors. Some of these separator/rejectors, for example, sort the coins and direct coins of different desired denominations into separate chutes whereby they are counted or recorded. Most contemporary systems employ an electronic register to record the number and denomination of such coins as they move through the separator chutes subsequent to separation in the coin race.

Many times, the principal design feature of a discrimination and rejection system is to limit the operations of a machine to a particular denomination of coin, as dictated by the price of the merchandise, service or entertainment available through the machine. Other times, a principal desire is to limit the size of the machine as dictated by space concerns. There is generally very limited space in most machines for a coin rejector; and this is especially the case when the rejector must be capable of accepting a variety of denominations. In most all instances, it is desirable to reject pennies and foreign coins.

An exemplary coin discrimination system which addresses the foregoing needs is that one disclosed in applicant's U.S. Pat. No. 4,911,2805 ("the '280 patent") as issued for a "Method and Apparatus for Deflecting Coins While Maintaining an on Edge Orientation". The '280 patent provides the ability to discriminate among several differently sized coins by moving all coins which fit in the coin inlet portal along a downwardly descending coin race. This coin race includes means to bias these coins against a series of differently sized openings. While the system disclosed in the '280 patent represents the state in the art of mechanical coin discrimination systems, other discrimination systems employ the use of electronic sensors which separate valued and counterfeit coins.

Coin discrimination and rejection systems such as those described above are specifically adapted to discriminate among favored coinage and undesired currency, tokens and slugs. Such systems, however, are sometimes susceptible to the use of other means and methods for improperly obtaining access to the vending machine or other apparatus in which the subject system is installed. For example, it has become commonplace for individuals to attempt to force a wire, e.g., a coat hanger, into the coin access slot of some coin-operated machines in an attempt to induce the coin register into crediting the deposition of proper coinage. It is also common for individuals to attempt to use coinage which is fixed to a tape or plastic strip which is inserted into the access slot to obtain a value register of the value of coins where the coinage is subsequently withdrawn. Still alternately, coin discrimination systems used in car washes have sometimes been subjected to the intentional introduction of high pressure water and soap through the coin access slot for the purpose of establishing an electrical contact in the coin register to obtain free products and services.

SUMMARY OF THE INVENTION

The present invention addresses the above and other disadvantages of prior art coin discrimination and rejection systems by incorporating fraud protection means to prevent access to the coin discriminator from a position exterior to the access slot of the coin operated machine. The present invention also includes means to prevent the introduction of coins and/or foreign objects into the coin race once the coin return feature has been engaged.

In one embodiment of the invention, a selector assembly comprising a rigid, arcuate control element is pivotally disposed with respect to the rejector body with its second or downstream end biased across the coin race. A coin traveling downwardly along the coin race will engage the second end of the element, thereby moving the second end to a non-engaging position so as to allow the coin to continue its downward movement toward the coin register. Engagement of the second end by the coin serves to pivot the first end of the control element across the coin race, thereby blocking the further introduction of coins or foreign objects into the coin race until the first coin has moved through the coin register. In such a fashion, neither a wire or a tethered coin system may successfully be introduced down into the coin race without being caught and/or blocked by the selector assembly. If manufactured to fit over an entire cross-section of the coin race, the aforedescribed selector assembly will also serve to substantially prevent any attempted injection of water or other fluids into the coin race and into the coin register.

A second embodiment of the invention is contemplated for use with discrimination and rejection systems of the type disclosed and claimed in the '280 patent which includes at least one hinged wall portion which is biased in a "closed" orientation against the rejector body and which may be moved to an "open" position when the release and subsequent rejection of coins in the race is desired, e.g. the coin return. In this embodiment, a fencing assembly is positioned proximate the coin access portal and normal to the plane defined by the coin race. The fencing assembly comprises a substantially rigid element which is slidably disposed vis-a-vis the coin race such that when the coin return feature is engaged, thereby moving the hinged wall to an "open" or outward position, the rigid element moves across the coin race, thereby blocking access to the further introduction of coins. Concomitantly, the lateral movement of the fencing assembly also serves to prevent any attempt to introduce a wire or other foreign object into the coin race when the coin return mechanism is engaged.

The present invention presents a number of advantages over prior art coin discrimination and rejection systems. One such advantage is the ability to modify and/or prevent the introduction of any tampering element which is inserted from a position outside the coin access slot of the coin-operated device.

A second advantage of the present invention is the ability to block access to the coin race when an attempt is made to reject coins. In such a fashion, tampering is substantially prevented. This feature also prevents the introduction of additional coinage if the coin race is somehow obstructed or blocked, thereby mitigating customer frustration.

Other advantages of the present invention will become obvious in light of the following detailed description of the preferred embodiment.

BRIEF DESCRIPTION OF THE DRAWINGS

FIG. 1 is a rear perspective view of one embodiment of the coin discrimination and rejection system of the present invention.

FIG. 2 is a side view of the discrimination and rejection system of FIG. 1.

FIG. 3 is an opposite, side view of the embodiment of the invention illustrated in FIG. 2.

FIG. 4 is a perspective, detail view of the embodiment illustrated in FIG. 2.

FIG. 5 is a top, detail view of the embodiment of the invention illustrated in FIG. 1.

FIG. 6 is a perspective, detail view of an alternate embodiment of the selector assembly of the invention.

FIG. 7 is a top, detail view of the embodiment illustrated in FIG. 6.

DETAILED DESCRIPTION OF THE PREFERRED EMBODIMENTS

Figure 8:
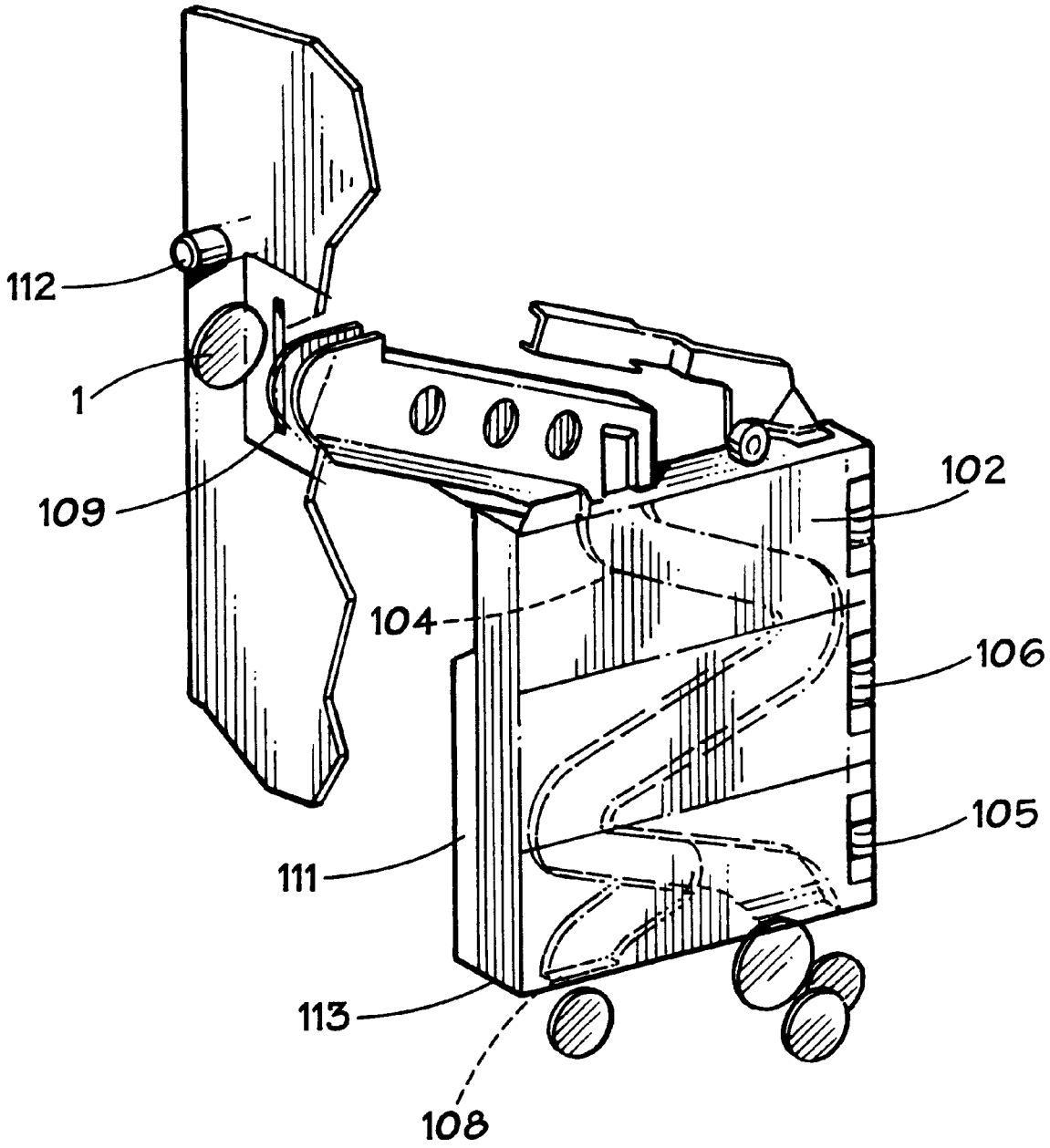
FIG. 8 is a perspective view of a prior art coin discrimination assembly.

FIG. 8 illustrates a prior coin discrimination and rejector assembly 100 such as that disclosed and claimed in U.S. Pat. No. 4,911,280 (the '280 patent), which assembly comprises a coin rejector body 102, an inlet portal 104 disposed above a coin race 106, a coin slot 109 and a coin outlet 108 which is disposed above a coin register (not shown). Also illustrated in FIG. 1 is a means to initiate a coin rejection, typically characterized by an external button 112 or knob engageable by the consumer and situated on the external face of the coin-operated device.

The discrimination assembly disclosed in FIG. 8 utilizes two or more vertically disposed plates or wall members, specifically a baseplate 113 and a gate 111, which are biased together to form the body 102 and which define coin race 106. Engagement of coin return means by depressing coin return button 112 forces gate 111 to pivot outwardly about a hinge 115, thereby releasing all coins then positioned in coin race 106 where they may be collected or returned to the user.

While the discriminator and rejector system illustrated in FIG. 8 is exceptionally efficient at discriminating among various denominations of coins, slugs and tokens, this apparatus is sometimes susceptible to the introduction of foreign objects into the race to fraudulently procure goods or services attainable through the coin-operated machine.

One embodiment of the selection assembly of the present invention is seen by reference to FIGS. 1–5 and is particularly adapted for use with discrimination systems such as that illustrated in FIG. 8. By reference to these figures, there is seen a rejector body 20 in which is formed a coin inlet portal 22 disposed above a downwardly curved coin race 24 terminating in a coin outlet 26. Body 20 may be formed from a nylon, plastic or other durable material. In the illustrated embodiment, body 20 may be comprised of at least two sections, a baseplate 10 and a gate 12, which elements are biased together about a spring 13, as will be further discussed below.

Inlet portal 22 is usually characterized by a coin inlet slot (not shown), which is sized to accept specific diameter and width coins. In the embodiment illustrated in FIGS. 1–5, rejector body 20 and coin race 24 are formed in accordance with the disclosures of the '280 patent. It should be realized, however, that the selector assembly of the present invention has application to rejectors of all types of coin discrimination systems including, but not limited to, mechanical and electronic rejectors.

In the embodiment illustrated in FIGS. 1–5, coin race 24 is generally formed about a plane which is vertically disposed through rejector body 20, which plane includes coin inlet portal 22 and coin outlet 26. A selector assembly 30 comprising a substantially rigid discriminator element 32 is pivotally disposed proximate race 24 about a pivot pin 42 which is mounted on a flange 44. It is contemplated that flange 44 may be formed integrally with body 30 or may be affixed to body 20 by conventional means.

Selector element 32 defines a first, upstream end 48 and a second, downstream end 50, where said pivot pin 42 is coupled to said element 32 between said first and second ends, 48 and 50. Element 32 is so positioned so that one of ends 48 and 50 is at least partially situated across race 24 at any given time. In a preferred embodiment, the pivot plane described by element 32 is substantially normal to the plane defined by coin race 24, although other spatial juxtapositions are also contemplated within the spirit of the invention.

Downstream end 50 of element 32 is preferably biased across race 24 by a spring 51 or other suitably biasing element so that it will engage a coin 1 introduced through coin inlet 22 and traveling downwardly along race 24. Spring 51 may be coupled between said element 32 and an anchor which, in the illustrated embodiment, is a fence element 60 as will be discussed below. It is contemplated that the anchor may also constitute an independent element which may be affixed to body 20 in a conventional fashion.

In a preferred embodiment for use with United States coinage, spring 51 is made from a non-ferrous metal. One such spring is made from Inconel 600 by Leeco Spring International of Houston, Tex. It is envisioned, however, that other types of springs and biasing means in general may be used to achieve the objects of the invention.

A coin 1 engaging downstream end 50 of element 32 depresses said downstream end 50 to the side of race 24 thereby pivoting upstream end 48 across race 24 to block the introduction of other coins or foreign objects therealong until such time as coin 1 moves downstream of end 50, whereby end 50 returns to its original position across coin race 24 (see FIG. 7). In such a fashion, "jamming" of the coin discriminator may be prevented by compelling a spaced progression of coins 1 along coin race 24. The selector assembly 30 of the present invention also serves to prevent any attempt to introduce a wire or other device tethered through the coin inlet since such device, once it engages the second or downstream end 50 of element 32, will become lodged in the race 24 when first end 48 pivots across the race 24. Similarly, once a tethered coin passes downstream of downstream end 50, the end 50 will assume its original orientation across race 24, further preventing the extraction of the tethered coin.

In the embodiment illustrated in FIGS. 1–5, element 32 may comprise a rigid wire defining an arcuate shape so as to allow both upstream and downstream ends to extend across race 24. Such wire may be made of stainless steel, aluminum or other suitable material. In an alternate embodiment, at least the upstream end 48 of element 32 may be formed from a material defining a frontal section formed substantially across the entirety of coin race 24 when in a "blocking" position. (See FIG. 6.) In such an embodiment, element 32 may also serve to substantially restrict the passage of water into coin race 24 and ultimately into the coin register (not shown).

Figure 9:
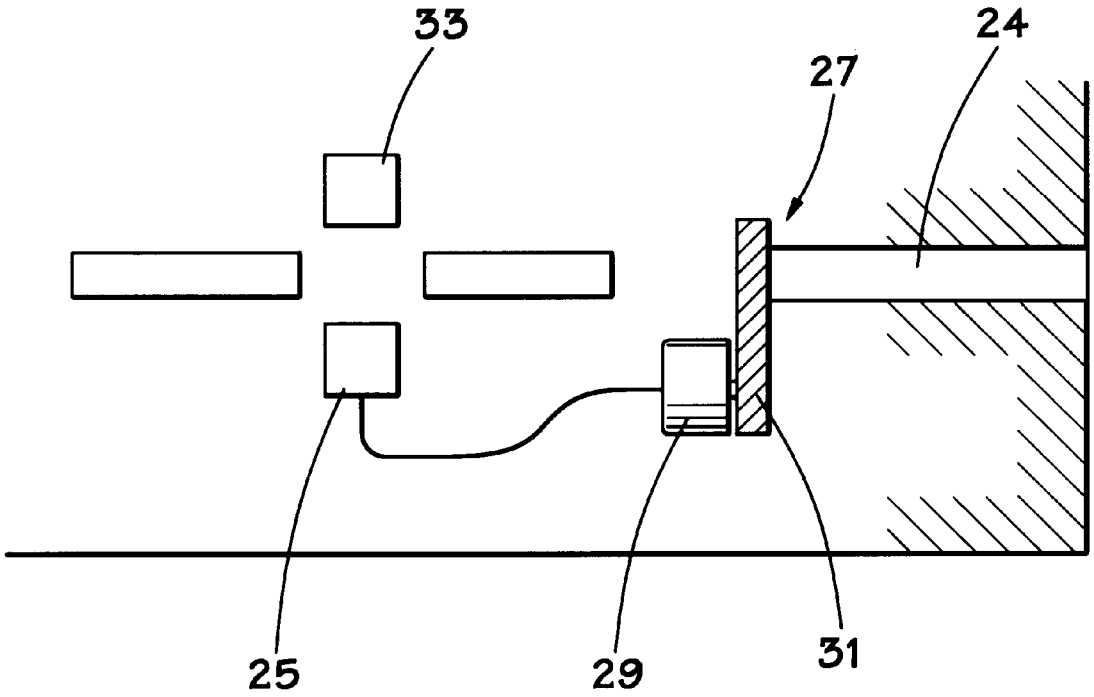
FIG. 9 is a top, detail view of an alternate embodiment of the invention.

A variation on the embodiment discussed above in association with FIGS. 1–5 is one which utilizes an electronic sensor in association with mechanical means to induce spacing between coins introduced into coin race 24, as shown in FIG. 9. It is envisioned that an electronic sensor 25, e.g. an infrared sensor, light emitting diode or inductive sensor may be situated proximate coin race 24 downstream from a mechanical agent 27 adapted to move across race 24 upon receipt of an electrical signal from the sensor. In the instance when sensor 25 is a light emitting diode, a corresponding receiver 33 is provided. This mechanical agent 27 could include a solenoid or a stepper motor 29 coupled to an arm 31 whose terminal end, when in an engaged position, extends across race 24.

Yet another embodiment of the invention may be seen by reference to FIGS. 3, 4 and 6. In these figures, selector assembly 30 is operable with a fence element 60 which is slidably disposed with respect to rejector body 20 between an "engaged" and a "nonengaged" position across coin race 24. In a preferred embodiment, screening element 60 is positioned immediately downstream from coin inlet portal 22. Screening element 60 is preferably designed for adaptation with coin discriminators of the type disclosed in the '280 patent which include a baseplate 113 and at least one complementary gate 111 (See FIG. 5). It is envisioned, however, that said element may have application to coin rejection systems employing a unitary body.

The upper end 62 of element 60 is slidably disposed vis-a-vis body 20 through a second aperture 83 between an "engaged" and "non-engaged" portion. Element 60 is ordinarily positioned in the "non-engaged" portion, in which case upper end 62 is disposed adjacent to but not across race 24. Aperture 83 is formed transverse to coin race 24 such that when element 60 is disposed in an "engaged" position, end 62 slides through said aperture across coin race 24 to block the introduction of coins into race 24.

Element 60 preferably comprises a first or upper end 62 and a second or lower end 64 bounded by an arcuate mid-portion 63 so as to allow both ends 62 and 64 to be substantially parallel. Lower end 64 extends through an aperture 82 formed in both baseplate 113 and gate 111, where such aperture 82 is formed beneath race 24. The terminal extent of end 64 includes a retainer 55 or other physical stop to prevent said end 64 from sliding out of body 20. (See FIG. 5.)

Element 60 is operatively coupled to coin return means such that activation of said means moves end 62 across race 24 to an "engaged" position, thereby preventing the introduction of coins or any foreign objects into race 24 through inlet portal 22. When the coin return means is engaged, baseplate 113 and gate 111 are separated so as to allow coins to be removed from race 24 for return to the user. Separation of elements 111 and 113 serves to pull terminal end 62 across race 24, thereby preventing the placement of additional coins in coin inlet 22. Screening element 60 is likewise induced to move across race 24 when elements 111 and 113 are separated as a result of the collection of coins in coin race 24 as a result of blockage.

While screen element 60 is shown as used in conjunction with selector assembly 30, it is also contemplated that screen element 60 could comprise an independent anti-fraud device for use with other types of coin-operated devices. In this connection, it is envisioned within the spirit of the invention that element 60 could be biased in a "non engaged" position, where such bias is overcome by mechanical means in response to an electric signal that a coin has remained in said race 24 as a result of a coin jamming event or the attempted use of a tethered coin, as described above, for a time exceeding a preset limit. The electrical signal would be derived from a monitoring means, e.g. an infrared sensor, disposed proximate coin race 24.

In one aspect, it is contemplated that the mechanical means could comprise a solenoid (not shown) coupled to the coin discriminator body 20 such that said solenoid would impart a reciprocating force transverse to the plane defined by the coin race. In such an embodiment, the operative piston of the solenoid would be coupled to the screening element such that upon receipt of an electrical signal at least one of ends 60 or 62 would be moved across race 24 to block the attempted introduction of coins at the coin inlet. A solenoid operable in such an embodiment is made, for example, by Magnet Shultz.

Although particular detailed embodiments of the apparatus and method have been described herein, it should be understood that the invention is not restricted to the details of the preferred embodiment. Many changes in design, composition, configuration and dimensions are possible without departing from the spirit and scope of the instant invention.

What is claimed is:

1. In a coin separator and rejector including a body having an inlet coin portal and a downwardly inclined coin race positioned in the body below the inlet portal and adapted to receive a coin from said portal, a fraud prevention system comprising: an element defining a first upstream end and a second downstream end, where said element is adapted to pivot through a plane approximately normal to the plane defined by said coin race, and where said second end is biased across said coin race to engage a coin moving downwardly in said coin race such that engagement of said second end by said coin moving along said coin race serves to move said first end across said race until said coin moves along said race below said second end, and means for normally biasing said second end across said coin race.

2. The system of claim 1 where said element is non linear in configuration.

3. The system of claim 1 where said element comprises a wire defining an arcuate section bounded by said first and second ends.

4. The system of claim 1 where at least the first end of said element defines an engagement surface which substantially fills the coin race at the point where said first end pivots into said race.

5. In a coin separator and rejector including a body having an inlet coin portal and a downwardly inclined coin race positioned in the body below the inlet portal and adapted to receive a coin from said portal, a fraud prevention system comprising: an element defining a first upstream end and a second downstream end, where said element is adapted to pivot through a plane approximately normal to the plane defined by said coin race, and where said second end is biased across said coin race to engage a coin moving downwardly in said coin race such that engagement of said second end by said coin moving along said coin race serves to move said first end across said race until said coin moves along said race below said second end, wherein said body is comprised of two or more wall elements which are biased together to form said coin race, further including a second element slidably disposed about said coin rejector body between a first and a second position, where said second element includes a first and a second end and means to secure either said first or second end to one of said wall elements, wherein in said first position neither end of said second element is disposed across said coin race, but in said second position at least the first or second end is disposed across said race to prevent the introduction of objects into said race, where said second element is normally biased in said first position and is moveable to said second position by the separation of one or more of said wall elements.

6. The system of claim 5 where said first element is coupled to said second element.

7. The system of claim 6 where said first element is biased to said second means.

8. The system of claim 7 where said biasing means comprises a spring.

9. The system of claim 5 where said second element includes an arcuate section bounded by said first and second ends.

10. An assembly to create spacing between coins inserted in a coin-operated device which includes a body having a coin inlet, a downwardly disposed coin race and a coin outlet, said assembly comprising: a spacing element including a first and a second end, where said first end is pivotally biased across said coin race such that a first coin engaging said first end will depress said first end out of said coin race and pivot said second end into said coin race to block the passage of a second coin until said first coin has disengaged from said first end of said spacing element, and means for normally biasing said first end across said coin race.

11. The assembly of claim 10 where said element is arcuate in configuration.

12. The assembly of claim 10 where said first end is positioned downstream from said second end along said coin race.

13. The assembly of claim 10 where said second end is configured to completely fill said coin race when pivoted to an engaged position.

14. An anti-fraud feature for application to a coin-operated apparatus having a housing comprising two separable wall elements defining an internal coin race bounded by a coin inlet and a coin outlet and a coin return mechanism externally actuable by the user of said machine to separate said wall elements, said feature comprising a body reciprocally disposed with respect to said race between a first position where said body is disposed across said coin race to block the introduction of objects into said race and a second position where said body is disposed so as to allow the flow of coins down said race, where said body coupled to one of said wall elements such that said body is moveable to said first position by the separation of said wall elements.

15. The anti-fraud feature of claim 14, where the separation of said elements is acomplished by activation of a coin return mechanism.

16. The anti-fraud feature of claim 14 where said body includes a first and a second end bounded by an accurate section such that said first and second ends are substantially parallel.

17. The anti-fraud feature of claim 16 where said first and said second ends are slidably disposed in said body between said first and second positions such that said first end defines a track across said race and said second end defines a track below said race.

18. An anti-fraud feature for application to a coin-operated apparatus having a housing defining an internal coin race bounded by a coin inlet and a coin outlet, said feature comprising a body reciprocally disposed with respect to said race between a first position where said body is disposed across said coin race to block the introduction of objects into said race and a second position where said body is disposed so as to allow the flow of coins down said race, where said body is biased in said second position and movable to said first position by means which monitors the time when a given object remains in the coin race.

19. The anti-fraud feature of claim 18, wherein said monitoring means includes means for normally biasing said body in said second position disposed across said coin race.

20. The anti-fraud feature of claim 18 where said monitoring means includes an infrared sensor.

21. An anti-fraud feature for application to a coin-operated apparatus having a housing defining an internal coin race bounded by a coin inlet and a coin outlet, said feature comprising: a body reciprocally disposed with respect to said race between a first position where said body is disposed across said coin race to block the introduction of objects into said race and a second position where said body is disposed so as to allow the flow of coins down said race, where said body is biased in said second position and movable to said first position by means which monitors the time when a given object remains in the coin race, wherein said body is U-shaped and defines upper and lower traveling arms, where said upper arm is disposed to travel across said coin race to block the attempted introduction of coins in said race, and said lower arm is disposed to travel beneath said coin race, where said lower arm is coupled to said monitoring means.

22. An assembly to create spacing between coins inserted in a coin-operated device which includes a body having a coin inlet, a downwardly disposed coin race and a coin outlet, said assembly comprising a spacing element including a first means situated downstream of a second means, where said first means is adapted to both detect the passage of a coin moving down said coin race and generate a signal to said second means which is adapted to physically interrupt the movement of subsequent coins down said coin race for a selected period.

23. The assembly of claim 22 where said first means includes an infrared sensor.

24. The assembly of claim 22 where said first means includes an inductive sensor.

25. The assembly of claim 22, where said first means includes a light emitting diode and a receiver.

* * * * *